US011258187B2

(12) United States Patent
Tehran et al.

(10) Patent No.: US 11,258,187 B2
(45) Date of Patent: Feb. 22, 2022

(54) ANTENNA ARRAY FOR WIDE ANGLE BEAM STEERING

(71) Applicant: Samsung Electronics Co., Ltd., Suwon-si (KR)

(72) Inventors: Hamid Reza Memar Zadeh Tehran, Frisco, TX (US); Shadi Abu-Surra, Plano, TX (US); Gary Xu, Allen, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 15 days.

(21) Appl. No.: 16/828,667

(22) Filed: Mar. 24, 2020

(65) Prior Publication Data

US 2020/0412018 A1 Dec. 31, 2020

Related U.S. Application Data

(60) Provisional application No. 62/886,717, filed on Jun. 26, 2019.

(51) Int. Cl.

| | |
|---|---|
| ***H01Q 21/06*** | (2006.01) |
| ***H01Q 1/24*** | (2006.01) |
| ***H01Q 21/00*** | (2006.01) |
| ***H01Q 9/04*** | (2006.01) |

(52) U.S. Cl.

CPC ..... *H01Q 21/065* (2013.01); *H01Q 1/243* (2013.01); *H01Q 9/0407* (2013.01); *H01Q 21/0006* (2013.01)

(58) Field of Classification Search

CPC .. H01Q 21/065; H01Q 1/243; H01Q 21/0006; H01Q 9/0407; H01Q 21/24; H01Q 13/206

See application file for complete search history.

(56) References Cited

U.S. PATENT DOCUMENTS

| | | | |
|---|---|---|---|
| 6,642,889 | B1 | 11/2003 | McGrath |
| 8,665,158 | B2 | 3/2014 | Chung et al. |
| 9,525,211 | B2 | 12/2016 | Lee et al. |

(Continued)

FOREIGN PATENT DOCUMENTS

| | | | |
|---|---|---|---|
| WO | 2019/075172 | A1 | 4/2019 |

OTHER PUBLICATIONS

International Search Report of the International Searching Authority in connection with International Patent Application No. PCT/KR2020/008112 dated Sep. 29, 2020, 3 pages.

(Continued)

*Primary Examiner* — Daniel D Chang

(57) ABSTRACT

An antenna array and a wireless communication device including the antenna array. The antenna array includes a plurality of unit cells and a termination unit cell. The plurality of unit cells are connected in series via respective transmission lines. Each of the unit cells include a microstrip patch having two insets on a diagonal axis of the microstrip patch. The microstrip patch is connected to two of the transmission lines at the two insets, respectively. The termination unit cell is connected in series to one of the plurality of unit cells via one of the transmission lines. The termination unit cell includes a microstrip patch having an inset on a diagonal axis of the microstrip patch. The microstrip patch is connected to the one transmission line at the inset.

19 Claims, 14 Drawing Sheets

(56) References Cited

U.S. PATENT DOCUMENTS

| | | | | |
|---|---|---|---|---|
| 9,680,211 | B2 | 6/2017 | Kletsov et al. | |
| 9,755,311 | B2 | 9/2017 | Zhou et al. | |
| 2012/0293279 | A1 | 11/2012 | Gong et al. | |
| 2013/0027240 | A1* | 1/2013 | Chowdhury | G01S 13/584 342/94 |
| 2015/0009079 | A1 | 1/2015 | Bøjer | |
| 2018/0205154 | A1 | 7/2018 | Baik et al. | |
| 2019/0074599 | A1* | 3/2019 | Yu | H01Q 1/3233 |
| 2019/0086535 | A1 | 3/2019 | Meyer et al. | |
| 2019/0115644 | A1 | 4/2019 | Wang et al. | |

OTHER PUBLICATIONS

Chen et al., Research Article, "Design of Series-Fed Bandwidth-Enhanced Microstrip Antenna Array for Millimetre-Wave Beamforming Applications," Hindawi, International Journal of Antennas and Propagation, vol. 2019, Article ID 3857964, Jun. 3, 2019, 10 pages.

Ijaz et al., "A Series-fed Microstrip Patch Array with Interconnecting CRLH Transmission Lines for WLAN Applications," IEEE, 2013 7th European Conference on Antennas and Propagation (EuCAP), Gothenburg, Sweden, Apr. 8-12, 2013, 5 pages.

Shah et al., "Dual Linearly Polarized Microstrip Array Antenna," Trends in Telecommunications Technologies, Christos J. Bouras (Ed.). ISBN: 978-953-307-072-8, InTech, Available from: http://www.intechopen.com/books/trends-in-telecommunications-technologies/dual-linearly-polarized-microstrip-array-antenna, Mar. 1, 2010, 24 pages.

Thomas et al., "A Study on V-Shaped Microstrip Patch MIMO Antenna", Indonesian Journal of Electrical Engineering and Computer Science, vol. 5, No. 3, Mar. 2017, 6 pages.

* cited by examiner

ANTENNA ARRAY FOR WIDE ANGLE BEAM STEERING

CROSS-REFERENCE TO RELATED APPLICATION AND CLAIM OF PRIORITY

This application claims priority under 35 U.S.C. § 119(e) to U.S. Provisional Patent Application No. 62/866,717 filed Jun. 26, 2019, the disclosure of which is incorporated herein by reference in its entirety.

TECHNICAL FIELD

The present disclosure relates generally to an antenna structure. More specifically, the present disclosure relates to an antenna structure used for TeraHertz (THz) communication.

BACKGROUND

TeraHertz (THz) communication systems are an emerging technology in beyond 5G networks and 6G networks. THz communications systems utilize operation frequencies above 100 GHz to achieve improved channel capacity usage. At frequencies above 100 GHz, the architecture of THz communications systems encounter significant challenges in order to fulfill power requirements and compensate for relatively high losses and the challenges associated with the implementation at high frequencies (e.g., mmWave and sub-mmWave) hardware. The challenges associated with the hardware are particularly due to using components that are miniaturized or of a reduced size, in particular passive parts such as antenna hardware, power dividers, interconnects, etc., the sizes of which are determined by the operational wavelength.

Much of the hardware does not sufficiently fulfill the power requirements and compensate for the relatively high losses associated with THz communication systems. Much of the hardware that is capable of fulfilling the power requirements and compensates for the relatively high losses requires significant material and manufacturing costs. Accordingly, it is desirable to provide cost-effective hardware that fulfills the power requirements of THz communication systems and compensates for the relatively high losses associated with THz communication systems.

SUMMARY

Embodiments of the present disclosure include an antenna array and a wireless communication device including an antenna array.

In one embodiment, an antenna array includes a plurality of unit cells and a termination unit cell. The plurality of unit cells are connected in series via respective transmission lines. Each of the unit cells includes a microstrip patch having two insets on a diagonal axis of the microstrip patch. The microstrip patch is connected to two of the transmission lines at the two insets, respectively. The termination unit cell is connected in series to one of the plurality of unit cells via one of the transmission lines. The termination unit cell includes a microstrip patch having an inset on a diagonal axis of the microstrip patch. The microstrip patch is connected to the one transmission line at the inset.

In another embodiment, a wireless communication device includes a transceiver and an antenna array operably connected thereto. The antenna array includes a sub-array that includes a plurality of unit cells and a termination unit cell.

The plurality of unit cells are connected in series via respective transmission lines. Each of the unit cells includes a microstrip patch having two insets on a diagonal axis of the microstrip patch. The microstrip patch is connected to two of the transmission lines at the two insets, respectively. The termination unit cell is connected in series to one of the plurality of unit cells via one of the transmission lines. The termination unit cell includes a microstrip patch having an inset on a diagonal axis of the microstrip patch. The microstrip patch is connected to the one transmission line at the inset.

In this disclosure, the terms antenna, antenna module, antenna array, beam, and beam steering are frequently used. An antenna module may include one or more arrays. One antenna array may include one or more antenna elements. Each antenna element may be able to provide one or more polarizations, for example vertical polarization, horizontal polarization or both vertical and horizontal polarizations at or around the same time. Vertical and horizontal polarizations at or around the same time can be refracted to an orthogonally polarized antenna. An antenna module radiates the accepted energy in a particular direction with a gain concentration. The radiation of energy in the particular direction is conceptually known as a beam. A beam may be a radiation pattern from one or more antenna elements or one or more antenna arrays.

Other technical features may be readily apparent to one skilled in the art from the following figures, descriptions, and claims.

Before undertaking the DETAILED DESCRIPTION below, it may be advantageous to set forth definitions of certain words and phrases used throughout the present disclosure. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout the present disclosure. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which like reference numerals represent like parts.

DETAILED DESCRIPTION

FIGS. 1 through 7D, discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged wireless communication system.

To meet the demand for wireless data traffic having increased since deployment of 4G communication systems, efforts have been made to develop an improved 5G or pre-5G communication system. Therefore, the 5G or pre-5G communication system is also called a "beyond 4G network" or a "post LTE system."

The 5G communication system is considered to be implemented in higher frequency (mmWave) bands and sub-6 GHz bands, e.g., 3.5 GHz bands, so as to accomplish higher data rates. To decrease propagation loss of the radio waves and increase the transmission coverage, the beamforming, Massive MIMO, full dimensional MIMO (FD-MIMO), array antenna, an analog beam forming, large scale antenna techniques and the like are discussed in 5G communication systems.

In addition, in 5G communication systems, development for system network improvement is under way based on advanced small cells, cloud radio access networks (RANs), ultra-dense networks, device-to-device (D2D) communication, wireless backhaul communication, moving network, cooperative communication, coordinated multi-points (CoMP) transmission and reception, interference mitigation and cancellation and the like.

Figure 1:
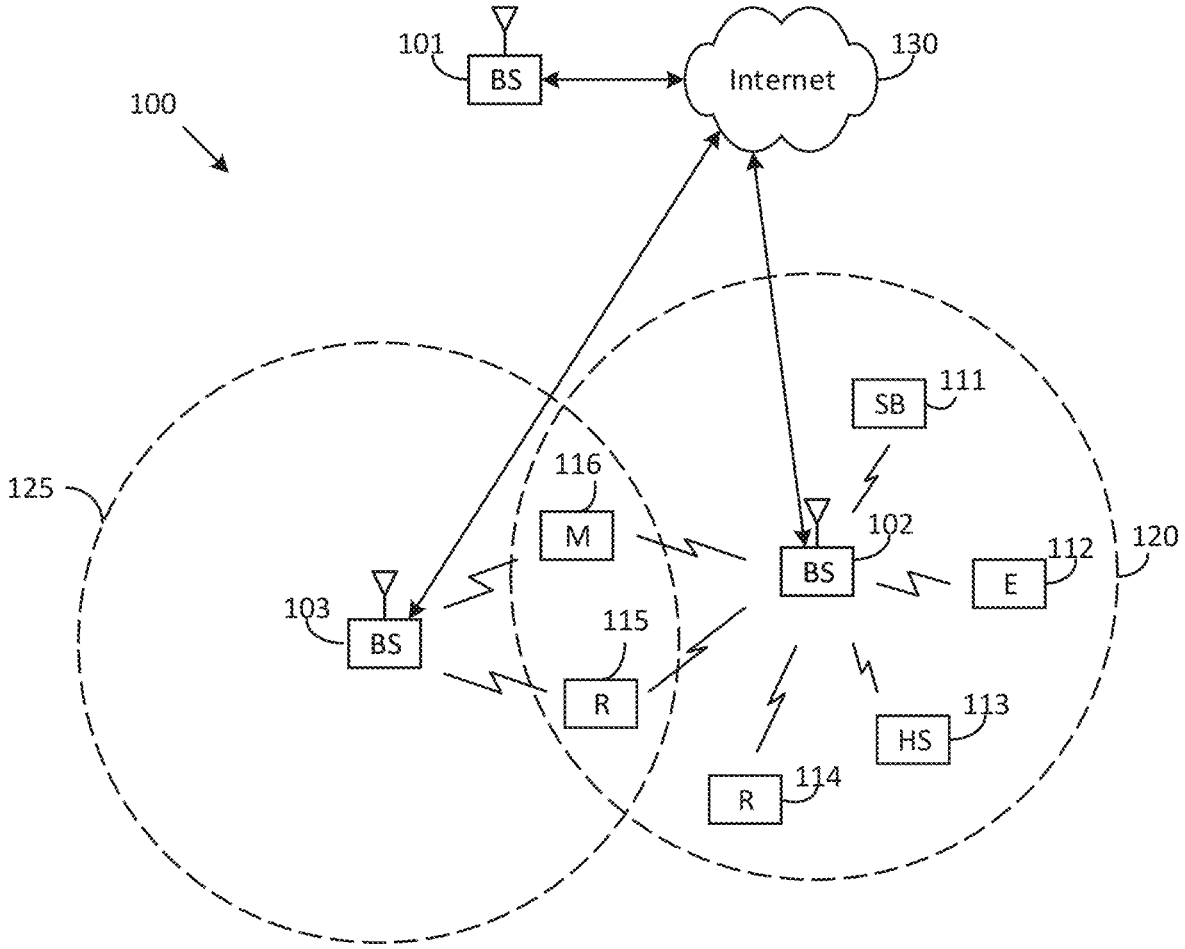
FIG. 1 illustrates a system of a network according to various embodiments of the present disclosure.

FIG. 1 illustrates an example wireless network according to embodiments of the present disclosure. The embodiment of the wireless network shown in FIG. 1 is for illustration only. Other embodiments of the wireless network 100 could be used without departing from the scope of this disclosure.

As shown in FIG. 1, the wireless network 100 includes a gNB 101, a gNB 102, and a gNB 103. The gNB 101 communicates with the gNB 102 and the gNB 103. The gNB 101 also communicates with at least one network 130, such as the Internet, a proprietary Internet Protocol (IP) network, or other data network.

The gNB 102 provides wireless broadband access to the network 130 for a first plurality of UEs within a coverage area 120 of the gNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M), such as a cell phone, a wireless laptop, a wireless PDA, or the like. The gNB 103 provides wireless broadband access to the network 130 for a second plurality of UEs within a coverage area 125 of the gNB 103. The second plurality of UEs includes the UE 115 and the UE 116. In some embodiments, one or more of the gNBs 101-103 may communicate with each other and with the UEs 111-116 using 5G, LTE, LTE-A, WiMAX, WiFi, or other wireless communication techniques.

Depending on the network type, the term "base station" or "BS" can refer to any component (or collection of components) configured to provide wireless access to a network, such as transmit point (TP), transmit-receive point (TRP), an enhanced base station (eNodeB or gNB), a 5G base station (gNB), a macrocell, a femtocell, a WiFi access point (AP), or other wirelessly enabled devices. Base stations may provide wireless access in accordance with one or more wireless communication protocols, e.g., 5G 3GPP new radio interface/access (NR), long term evolution (LTE), LTE advanced (LTE-A), high speed packet access (HSPA), Wi-Fi 802.11a/b/g/n/ac, etc. For the sake of convenience, the terms "BS" and "TRP" are used interchangeably in the present disclosure to refer to network infrastructure components that provide wireless access to remote terminals. Also, depending on the network type, the term "user equipment" or "UE" can refer to any component such as "mobile station," "subscriber station," "remote terminal," "wireless terminal," "receive point," or "user device." For the sake of convenience, the terms "user equipment" and "UE" are used in the present disclosure to refer to remote wireless equipment that wirelessly accesses a BS, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with gNBs, such as the coverage areas 120 and 125, may have other shapes, including irregular shapes, depending upon the configuration of the gNBs and variations in the radio environment associated with natural and man-made obstructions.

Although FIG. 1 illustrates one example of a wireless network, various changes may be made to FIG. 1. For example, the wireless network could include any number of gNBs and any number of UEs in any suitable arrangement. The gNB 101 could communicate directly with any number of UEs and provide those UEs with wireless broadband access to the network 130. Similarly, each gNB 102-103 could communicate directly with the network 130 and provide UEs with direct wireless broadband access to the network 130. Further, the gNBs 101, 102, and/or 103 could provide access to other or additional external networks, such as external telephone networks or other types of data networks.

Figure 2A:
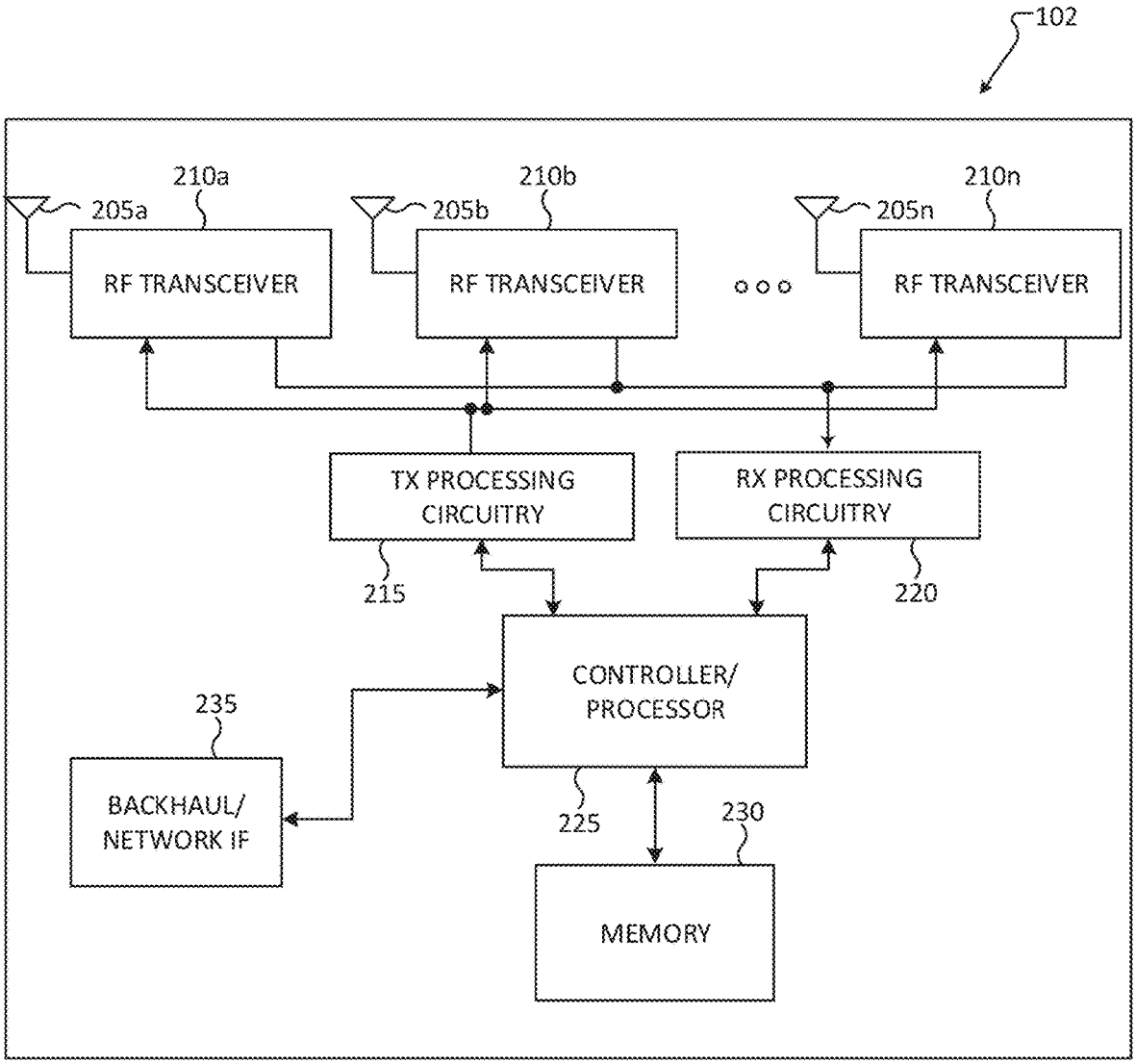
FIG. 2A illustrates a base station according to various embodiments of the present disclosure.

FIG. 2A illustrates an example gNB 102 according to embodiments of the present disclosure. The embodiment of the gNB 102 illustrated in FIG. 2A is for illustration only, and the gNBs 101 and 103 of FIG. 1 could have the same or similar configuration. However, gNBs come in a wide variety of configurations and FIG. 2A does not limit the scope of this disclosure to any particular implementation of a gNB.

As shown in FIG. 2A, the gNB 102 includes multiple antennas 205*a*-205*n*, multiple radiofrequency (RF) transceivers 210*a*-210*n*, transmit (TX) processing circuitry 215, and receive (RX) processing circuitry 220. The gNB 102 also includes a controller/processor 225, a memory 230, and a backhaul or network interface 235. In various embodiments, the antennas 205*a*-205*n* may be a high gain and large bandwidth antenna that may be designed based on a concept of multiple resonance modes and may incorporate a stacked or multiple patch antenna scheme.

The RF transceivers 210*a*-210*n* receive, from the antennas 205*a*-205*n*, incoming RF signals, such as signals transmitted by UEs in the wireless network 100. The RF transceivers 210*a*-210*n* down-convert the incoming RF signals to generate IF or baseband signals. The IF or baseband signals are sent to the RX processing circuitry 220, which generates processed baseband signals by filtering, decoding, and/or digitizing the baseband or IF signals. The RX processing circuitry 220 transmits the processed baseband signals to the controller/processor 225 for further processing.

The TX processing circuitry 215 receives analog or digital data (such as voice data, web data, e-mail, or interactive video game data) from the controller/processor 225. The TX processing circuitry 215 encodes, multiplexes, and/or digitizes the outgoing baseband data to generate processed baseband or IF signals. The RF transceivers 210*a*-210*n* receive the outgoing processed baseband or IF signals from the TX processing circuitry 215 and up-converts the baseband or IF signals to RF signals that are transmitted via the antennas 205*a*-205*n*.

The controller/processor 225 can include one or more processors or other processing devices that control the overall operation of the gNB 102. For example, the controller/processor 225 could control the reception of forward channel signals and the transmission of reverse channel signals by the RF transceivers 210*a*-210*n*, the RX processing circuitry 220, and the TX processing circuitry 215 in accordance with well-known principles. The controller/processor 225 could support additional functions as well, such as more advanced wireless communication functions. For instance, the controller/processor 225 could support beam forming or directional routing operations in which outgoing/incoming signals from/to multiple antennas 205*a*-205*n* are weighted differently to effectively steer the outgoing signals in a desired direction. Any of a wide variety of other functions could be supported in the gNB 102 by the controller/processor 225.

The controller/processor 225 is also capable of executing programs and other processes resident in the memory 230, such as an OS. The controller/processor 225 can move data into or out of the memory 230 as required by an executing process.

The controller/processor 225 is also coupled to the backhaul or network interface 235. The backhaul or network interface 235 allows the gNB 102 to communicate with other devices or systems over a backhaul connection or over a network. The interface 235 could support communications over any suitable wired or wireless connection(s). For example, when the gNB 102 is implemented as part of a cellular communication system (such as one supporting 5G, LTE, or LTE-A), the interface 235 could allow the gNB 102 to communicate with other gNBs over a wired or wireless backhaul connection. When the gNB 102 is implemented as an access point, the interface 235 could allow the gNB 102 to communicate over a wired or wireless local area network or over a wired or wireless connection to a larger network (such as the Internet). The interface 235 includes any suitable structure supporting communications over a wired or wireless connection, such as an Ethernet or RF transceiver.

The memory 230 is coupled to the controller/processor 225. Part of the memory 230 could include a RAM, and another part of the memory 230 could include a Flash memory or other ROM.

Although FIG. 2A illustrates one example of gNB 102, various changes may be made to FIG. 2A. For example, the gNB 102 could include any number of each component shown in FIG. 2A. As a particular example, an access point could include a number of interfaces 235, and the controller/processor 225 could support routing functions to route data between different network addresses. As another particular example, while shown as including a single instance of TX processing circuitry 215 and a single instance of RX processing circuitry 220, the gNB 102 could include multiple instances of each (such as one per RF transceiver). In addition, various components in FIG. 2A could be combined, further subdivided, or omitted and additional components could be added according to particular needs. As described in greater detail below, an antenna array 500 can be implemented in the gNB 102 illustrated in FIG. 2A.

Figure 2B:
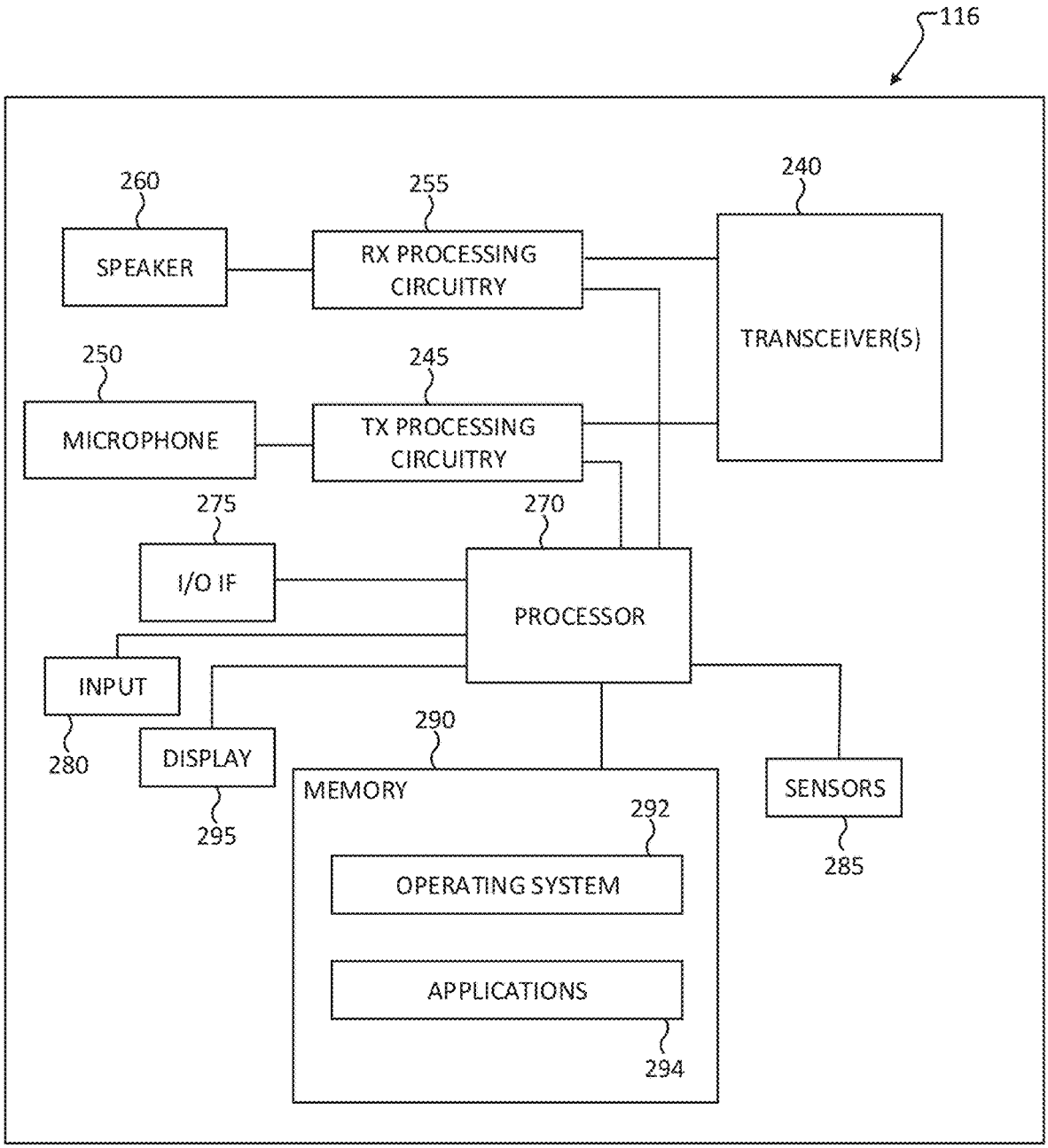
FIG. 2B illustrates a user equipment (UE) according to various embodiments of the present disclosure.

FIG. 2B illustrates a user equipment (UE) according to various embodiments of the present disclosure. The embodiment of the UE 116 illustrated in FIG. 2B is for illustration only, and the UEs 111-115 of FIG. 1 can have the same or similar configuration. However, UEs come in a wide variety of configurations, and FIG. 2B does not limit the scope of the present disclosure to any particular implementation of a UE.

The UE 116 includes one or more transceivers 240, transmit (TX) processing circuitry 245, a microphone 250, and receive (RX) processing circuitry 255. The UE 116 also includes a speaker 260, a processor 270, an input/output (I/O) interface 275, an input 280, one or more sensors 285, a memory 290, and a display 295. The memory 290 includes an operating system (OS) program 292 and one or more applications 294.

The transceiver 240 receives an incoming signal transmitted by a gNB of the wireless network 100 of FIG. 1. The transceiver 240 down-converts the incoming RF signal to generate an intermediate frequency (IF) or baseband signal. The IF or baseband signal is sent to the RX processing circuitry 255, which generates a processed baseband signal by filtering, decoding, and/or digitizing the baseband or IF signal. The RX processing circuitry 255 transmits the processed baseband signal to the speaker 260 (such as for voice data) or to the processor 270 for further processing (such as for web browsing data).

The TX processing circuitry 245 receives analog or digital voice data from the microphone 250 or other outgoing baseband data (such as web data, e-mail, or interactive video game data) from the processor 270. The TX processing circuitry 245 encodes, multiplexes, and/or digitizes the outgoing baseband data to generate a processed baseband or IF signal. The RF transceiver 240 receives the outgoing processed baseband or IF signal from the TX processing circuitry 245 and up-converts the baseband or IF signal to an RF signal that is transmitted by the transceiver 240.

The processor 270 can include one or more processors or other processing devices and execute the OS program 292 stored in the memory 290 in order to control the overall operation of the UE 116. For example, the processor 270 can control the reception of forward channel signals and the transmission of reverse channel signals by the RF transceiver 240, the RX processing circuitry 255, and the TX processing circuitry 245 in accordance with well-known principles. In some embodiments, the processor 270 includes at least one microprocessor or microcontroller.

The processor 270 can execute other processes and programs resident in the memory 290, such as operations for NZP or ZP CSI-RS reception and measurement for systems described in embodiments of the present disclosure as described in embodiments of the present disclosure. The processor 270 can move data into or out of the memory 290 as part of an executing process. In some embodiments, the processor 270 is configured to execute the applications 294 based on the OS program 292 or in response to signals received from gNBs or an operator. The processor 270 is also coupled to the I/O interface 275, which provides the UE 116 with the ability to connect to other devices such as laptop computers and handheld computers. The I/O interface 275 is the communication path between these accessories and the processor 270.

The processor 270 is also coupled to the input 280 (e.g., keypad, touchscreen, button etc.) and the display 295. The operator of the UE 116 can use the input 280 to enter data into the UE 116. The display 295 can be a liquid crystal display or other display capable of rendering text and/or at least limited graphics, such as from web sites.

The memory 290 is coupled to the processor 270. The memory 290 can include at least one of a random-access memory (RAM), Flash memory, or other read-only memory (ROM).

As described in more detail below, the UE 116 can perform signaling and calculation for CSI reporting. Although FIG. 2B illustrates one example of UE 116, various changes can be made to FIG. 2B. For example, various components in FIG. 2B can be combined, further subdivided, or omitted and additional components can be added according to particular needs. As a particular example, the processor 270 can be divided into multiple processors, such as one or more central processing units (CPUs) and one or more graphics processing units (GPUs). Although FIG. 2B illustrates the UE 116 as a mobile telephone or smartphone, UEs can be configured to operate as other types of mobile or stationary devices.

As shown in FIG. 1, the gNB 102 illustrated in FIG. 2A and the UE 116 illustrated in FIG. 2B communicate as components of the wireless network 100. For example, signals transmitted by the transceiver 240 can be received by the antennas 205, and signals transmitted by the antennas 205 can be received by the transceiver 240. However, in some embodiments, operation of the transceiver, the antennas 205, or both can be challenging, particularly when implemented in high-frequency hardware.

Embodiments of the present disclosure recognize the significant challenges associated with high-frequency hardware. In particular, embodiments of the present disclosure recognize the challenges associated with components of reduced size that are determined by the operation wavelength and their fabrication tolerances nearly reach many of fabrication tolerances such as PCB and LTCC. Accordingly, various embodiments of the present disclosure provide cost-effective hardware that fulfills the power requirements of THz communication systems and compensates for the relatively high losses associated with THz communication systems. More particularly, various embodiments of the present disclosure provide a single layer THz array antenna for wide angle beam steering. While various embodiments are discussed as being used in connection with THz communication systems, the present disclosure is not limited thereto. For example, various embodiments of the present disclosure may be implemented in any frequency range communication system, including for example, GHz, MHz, 6G, 5G, LTE, 4G, 3G, etc. communication systems.

Figure 3A:
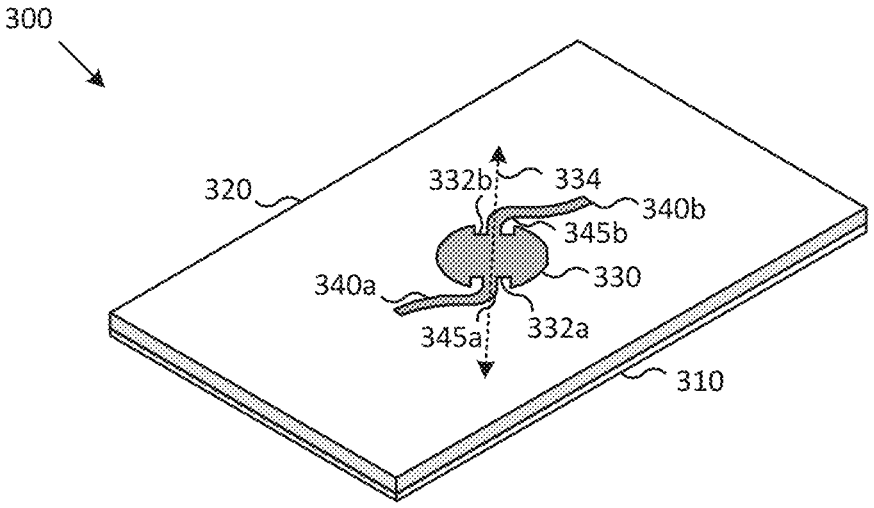
FIGS. 3A-3D illustrate a unit cell according to various embodiments of the present disclosure.
Figure 3B:
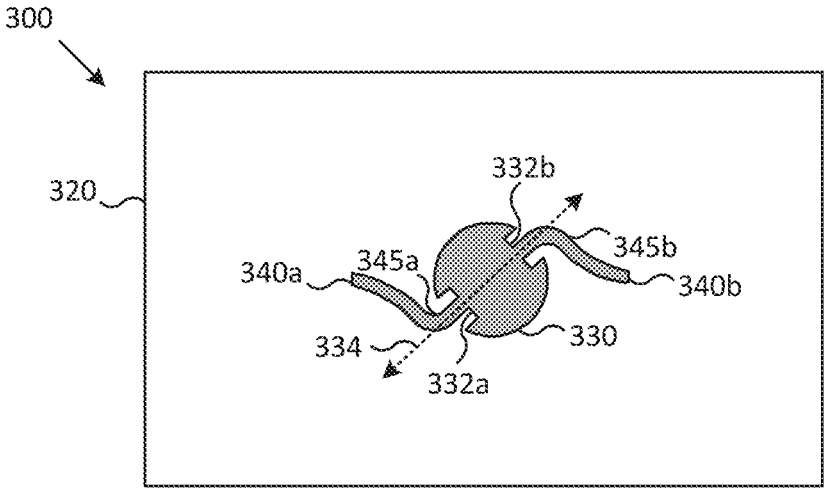
Figure 3C:
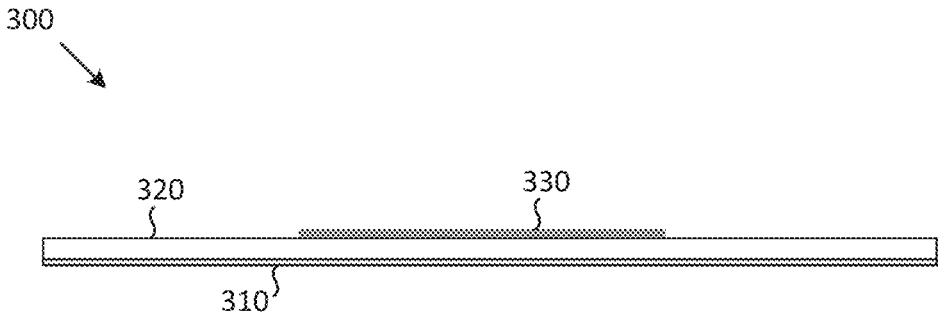

FIGS. 3A-3D illustrate a unit cell according to various embodiments of the present disclosure. FIG. 3A illustrates a top perspective view of a unit cell 300 according to various embodiments of the present disclosure. FIG. 3B illustrates a top view of a unit cell 300 according to various embodiments of the present disclosure. FIG. 3C illustrates a side view of a unit cell 300 according to various embodiments of the present disclosure.

The unit cell 300 includes a single dielectric substrate layer 320. The dielectric substrate layer 320 can be provided on a ground plane 310 disposed under the unit cell 300. The ground plane 310 forms the bottom layer of the unit cell 300 and can be any suitable conducting surface used in an antenna array that includes the unit cell 300. The ground plane 310 supports various propagation fundamental modes and improves the mechanical stability of the unit cell 300. Throughout the present disclosure, the terms "upper" and "lower" are not to be construed as limiting and are used only to describe the relative layers of the unit cell 300. For example, rotation of the unit cell 300 can result in the ground plane 310 being viewed as a top layer of the unit cell 300.

The dielectric substrate 320 can be any suitable insulating surface used in an antenna array that includes the unit cell 300. In various embodiments, the dielectric substrate 320 can be described as a single layer that includes each and every element of the unit cell 300. In other embodiments, the unit cell can be described as including the ground plane 310 as an additional layer of the unit cell 300. Various other components of the unit cell 300 can be disposed on or within the dielectric substrate 320 as described herein.

The unit cell 300 includes a patch 330. As illustrated in FIG. 3C, the patch 330 can be a microstrip patch disposed on top of the dielectric substrate 320. In various other embodiments, the dielectric substrate 320 can include a machined section of material removed and the patch 330 can be disposed within the removed section of the dielectric substrate 320. In this embodiment, the patch 330 can be described as disposed within the dielectric substrate 320. The patch 330 can be provided in a circular shape, a rectangular shape, or a square shape.

The patch 330 includes at least two insets, or notches, 332 disposed on a diagonal axis 334. As illustrated in FIGS. 3A and 3B, the patch 330 includes two insets 332*a*, 332*b* disposed on the diagonal axis 334. However, other embodiments are possible and the patch 330 can include more than two insets. For example, as illustrated in the unit cell 600 in FIGS. 6A-6C, a patch 630 can include four insets 632*a*, 632*b*, 632*c*, and 632*d* disposed on two diagonal axes. Other embodiments can include six insets disposed on three diagonal axes, eight insets disposed on four diagonal axes, or ten insets disposed on five diagonal axes. The first inset 332*a* is disposed one hundred-eighty degrees from the second inset 332*b*, corresponding to the diagonal axis 334. The at least two insets 332 reduce radiation and allow a beam to be more precisely steered.

The unit cell 300 includes two transmission lines 340*a*, 340*b*. The transmission lines 340 are series-fed diagonally into and out of, respectively, each of the two insets 332 of the unit cell 300 and connect the unit cell 300 to another unit cell 300, a termination cell 400, or a metallic carrier 520. The transmission lines 340 carry transmissions between the unit cell 300, a termination cell 400, and the metallic carrier 520. The transmission lines 340 further control a phase input and phase output of the unit cell 300. Each of the transmission lines 340*a*, 340*b* include a matching network section 345*a*, 345*b*, respectively, that matches, or connects, the transmission lines 340*a*, 340*b* to the insets 332*a*, 332*b* of the patch 330. The diagonal axis 334 where the transmission lines 340*a*, 340*b* connect to the insets 332*a*, 332*b* of the patch 330 provide a slanted polarization of approximately forty-five degrees.

Figure 3D:
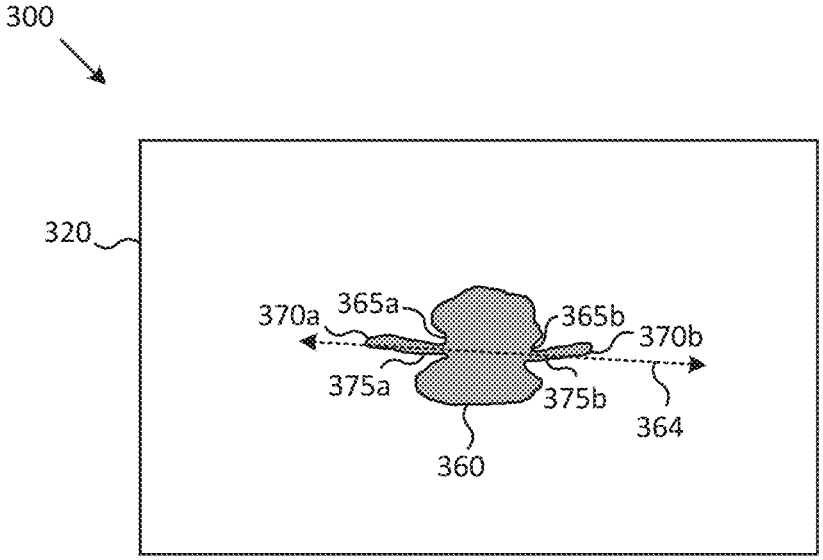

FIG. 3D illustrates a top view of a unit cell 300 according to another embodiment of the present disclosure. In particular, FIG. 3D illustrates the dielectric substrate 320 and a patch 360. The patch 360 is similar to the patch 330 and is provided in an irregular, circular shape in comparison to the patch 330. The patch includes a diagonal axis 364, at least two insets 365*a*, 365*b*, two transmission lines 370*a*, 370*b*, and matching network sections 375*a*, 375*b*. The diagonal axis 364 can be an equivalent axis to the diagonal axis 334. The at least two insets 365*a*, 365*b* can be equivalent to the at least two insets 335*a*, 335*b*. The two transmission lines 370*a*, 370*b* can be the transmission lines 340*a*, 340*b*. The matching network sections 375*a*, 375*b* can be equivalent to the matching network sections 345*a*, 345*b*.

The unit cell 300 can be implemented in various wireless communication devices, such as the UE 116 or the gNB 102. Some embodiments of the present disclosure provide a UE 116 that includes one or more arrays, where each array includes a plurality of unit cells 300. For example, as illustrated in FIGS. 7A-7D, the UE 116 can include a plurality of sub-arrays that each includes a plurality of unit cells such as the unit cell 300.

Various embodiments of the present disclosure recognize the challenges associated with linear antenna arrays including multiple unit cells 300. In particular, antennas that include linear antenna arrays can produce unwanted reflection of power back through a particular linear array. Accordingly, various embodiments of the present disclosure provide an element for passive termination to prevent the residual power from reflecting back to the linear antenna array. The element can be provided in the same, single layer THz array antenna for wide angle beam steering as multiple unit cells 300.

Figure 4A:
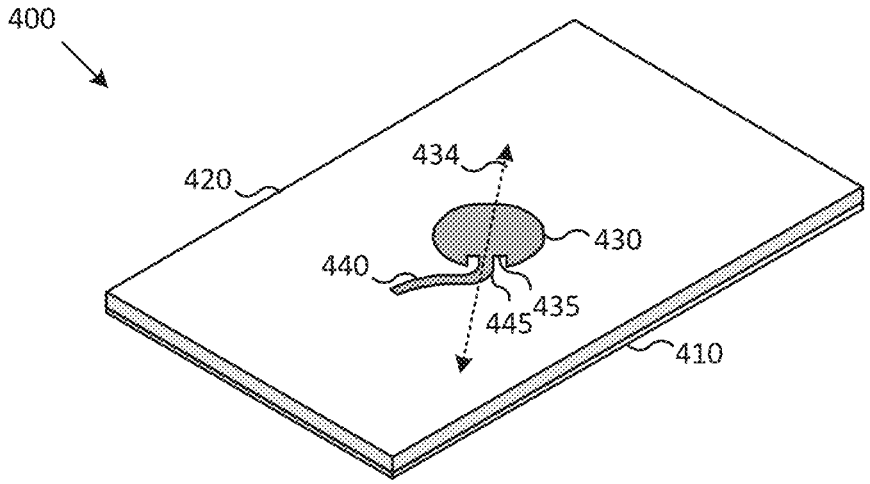
FIGS. 4A-4D illustrate a termination cell according to various embodiments of the present disclosure.
Figure 4B:
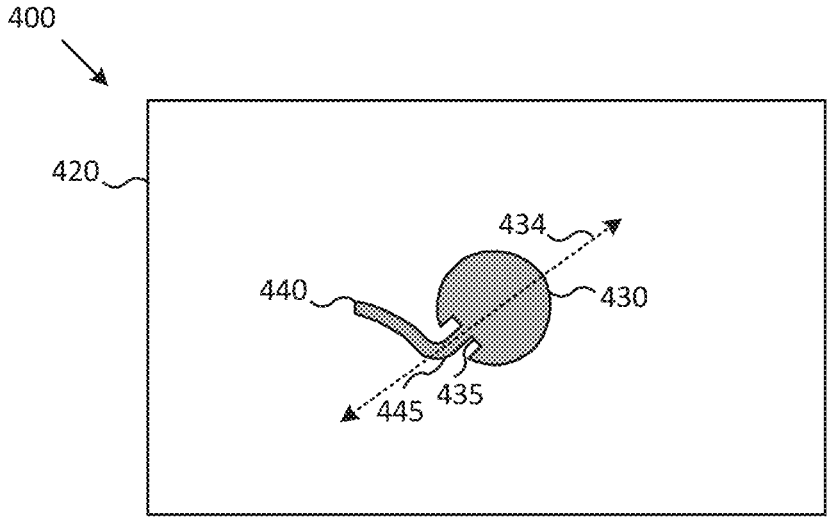
Figure 4C:
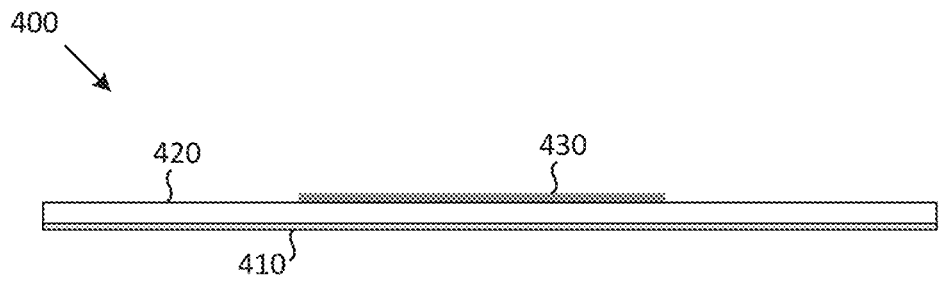

For example, FIGS. 4A-4D illustrate a termination cell according to various embodiments of the present disclosure. FIG. 4A illustrates a top perspective view of a termination cell 400 according to various embodiments of the present disclosure. FIG. 4B illustrates a top view of a termination cell 400 according to various embodiments of the present disclosure. FIG. 4C illustrates a side view of a termination cell 400 according to various embodiments of the present disclosure. In various embodiments, the termination cell 400 can be provided in an antenna array that includes one or more unit cells 300.

The termination cell, or termination unit cell, 400 includes a single dielectric substrate layer 420. The dielectric substrate layer 420 can be provided on a ground plane 410 disposed under the termination cell 400. The ground plane 410 forms the bottom layer of the termination cell 400 and can be any suitable conducting surface used in an antenna that includes the termination cell 400. The ground plane 410 supports various propagation fundamental modes and improves the mechanical stability of the termination cell 400. Throughout the present disclosure, the terms "upper" and "lower" are not to be construed as limiting and are used only to describe the relative layers of the termination cell 400. For example, rotation of the termination cell 400 can result in the ground plane 410 being viewed as a top layer of the termination cell 400.

The dielectric substrate 420 can be any suitable insulating surface used in an antenna that includes the termination cell 400. In various embodiments, the dielectric substrate 420 can be described as a single layer that includes each and every element of the termination cell 400. In other embodiments, the unit cell can be described as including the ground plane 410 as an additional layer of the termination cell 400. Various other components of the termination cell 400 can be disposed on or within the dielectric substrate 420 as described herein. In some embodiments, the ground plane 410 can be the ground plane 310 and the dielectric substrate 420 can be the dielectric substrate 320. In these embodiments, an antenna can include a single dielectric substrate disposed on a single ground plane that includes one or more unit cells 300 and a termination cell 400.

The termination cell 400 includes a patch 430. As illustrated in FIG. 4C, the patch 430 can be a microstrip patch disposed on top of the dielectric substrate 420. In various other embodiments, the dielectric substrate 420 can include a machined section of material removed and the patch 430 can be disposed within the removed section of the dielectric substrate 420. In this embodiment, the patch 430 can be described as disposed within the dielectric substrate 420. The patch 430 can be provided in a circular shape, a rectangular shape, or a square shape.

The patch 430 includes at least one inset 432, or notch, disposed on a diagonal axis 434. As illustrated in FIGS. 4A and 4B, the patch 430 includes an inset 432 disposed on the diagonal axis 434. However, other embodiments are possible and the patch 430 can include more than one inset. For example, a termination cell provided in an antenna array with the unit cell 600 illustrated in FIGS. 6A-6C can include two insets disposed on two diagonal axes. Other embodiments can include three insets disposed on three diagonal axes, four insets disposed on four diagonal axes, or five insets disposed on five diagonal axes.

The termination cell 400 includes a transmission line 440. The transmission line 440 connects the termination cell 400 to a unit cell 300. The transmission line 440 carries transmissions between the termination cell 400 and a unit cell 300. The transmission line 440 includes a matching network section 445 that matches, or connects, the transmission lines 440 to the inset 432 of the patch 430.

Figure 4D:
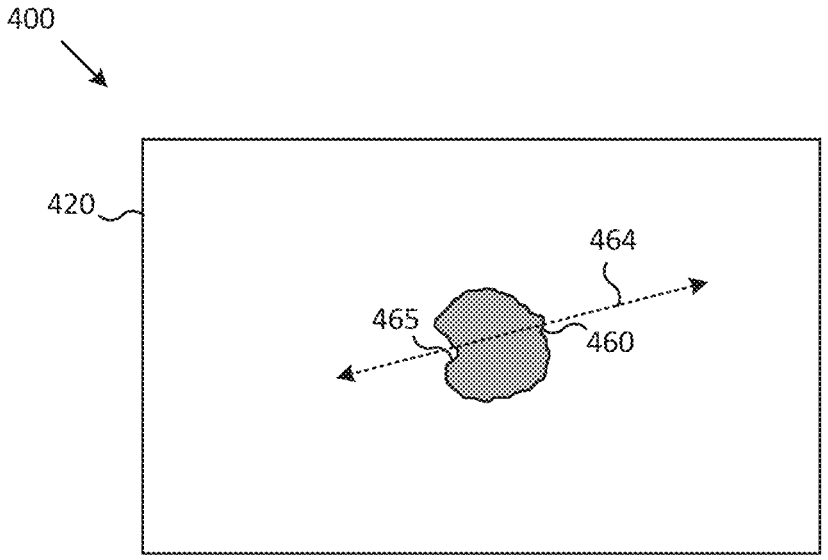

FIG. 4D illustrates a top view of a termination cell 400 according to another embodiment of the present disclosure. In particular, FIG. 4D illustrates the dielectric substrate 420 and a patch 460. The patch 460 is similar to the patch 430 and is provided in an irregular, circular shape in comparison to the patch 430. The patch includes a diagonal axis 464 and an inset 465. The diagonal axis 464 can be an equivalent axis to the diagonal axis 434. The inset 465 can be equivalent to the inset 432.

The termination cell 400 is the termination point for a sub-array that includes the termination cell 400 and one or more unit cells 300. As a transmission is carried through the array, the transmission is carried from unit cell 300 to unit cell 300. The termination cell 400 is provided at the end of the sub-array. The transmission can terminate, or cease, at the termination cell 400 or the transmission can be carried back in the opposite direction from which it was originally transmitted. The arrangement of a sub-array and the transmission mechanism is described in more detail in the description of FIGS. 5A-5C below.

The termination cell 400 can be implemented in various wireless communication devices, such as the UE 116 or the gNB 102. Some embodiments of the present disclosure provide a UE 116 that includes one or more arrays, where each array includes a plurality of unit cells 300 and a termination cell 400.

Figure 5A:
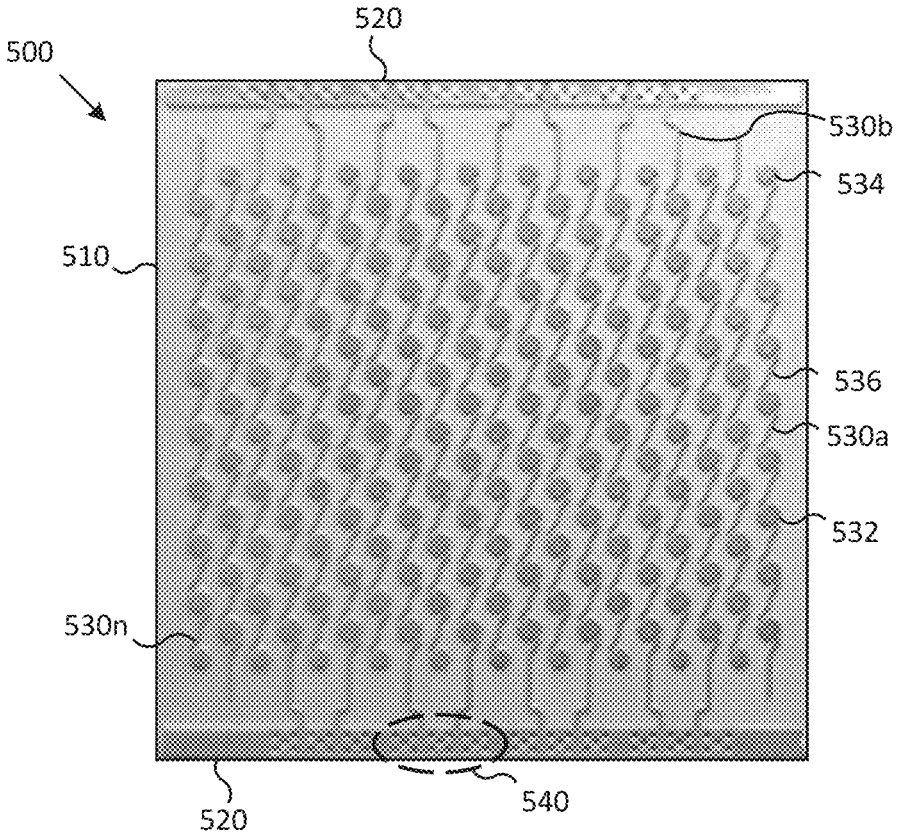
FIGS. 5A-5C illustrate an antenna array according to various embodiments of the present disclosure.
Figure 5B:
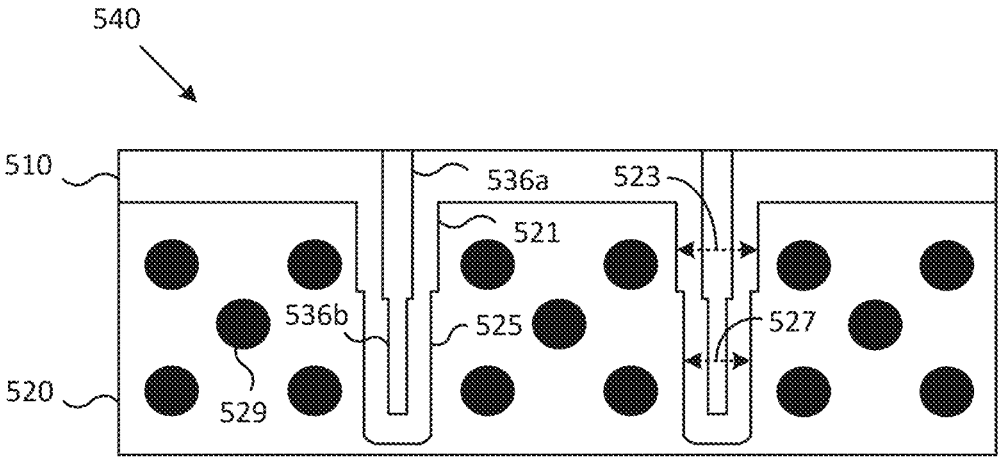
Figure 5C:
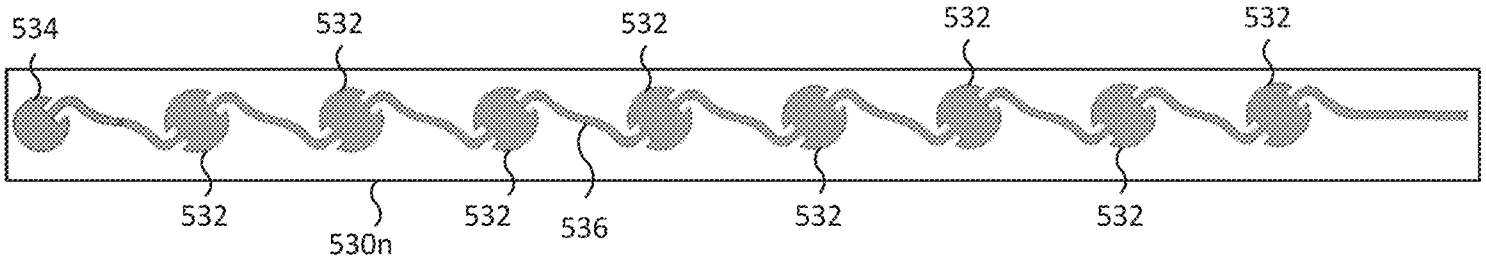

FIGS. 5A-5C illustrate an antenna array 500 according to various embodiments of the present disclosure. FIG. 5A illustrates an antenna array 500 according to various embodiments of the present disclosure. The antenna array 500 can be a THz antenna panel included in a UE 116 or a gNB 102. The antenna array 500 includes a dielectric substrate 510, a metallic carrier 520, and a plurality of sub-arrays 530*a*-530*n*.

The dielectric substrate 510 can be the dielectric substrate 320 or the dielectric substrate 420. As shown in FIG. 5A, the dielectric substrate 510 can be of a sufficient size such that multiple unit cells and termination cells can be disposed on or within the dielectric substrate 510. The dielectric substrate 510 includes metallic carriers 520 on opposite ends of the antenna array 500 with the plurality of sub-arrays 530*a*-530*n* disposed between the metallic carriers 520. The metallic carrier 520 can be a bonded wire and matching circuit that assists providing power to the antenna array 500.

The plurality of sub-arrays 530*a*-530*n* are disposed on the dielectric substrate 510. Each of the plurality of sub-arrays 530*a*-530*n* include a plurality of unit cells 532, a termination cell 534, and a transmission line 536. Each of the plurality of unit cells 532 can be the unit cell 300. The termination cell 534 can be the termination cell 400. The transmission line 536 can be the transmission line 340, 440 that connects a unit cell 532 to another unit cell 532 or the termination cell 534. Each of the plurality of sub-arrays 530*a*-530*n* are provided in a linear arrangement to facilitate the efficient and compact arrangement of multiple sub-arrays 530*n* on the antenna array 500.

The antenna array 500 can include various embodiments of the plurality of sub-arrays 530*a*-530*n*. For example, sub-array 530*a* includes eight unit cells 532, a transmission line 536, and a termination cell 534. The sub-array 530*a* is not coupled to a metallic carrier 520. Sub-array 530*b* includes eight unit cells, a transmission line 536, and a termination cell 534. In contrast to the sub-array 530*a*, the transmission line 536 of sub-array 530*b* is coupled to a metallic carrier 520 at the end distal to the termination cell 534. In other words, one end of the transmission line 536 terminates at the termination cell 534 and the other end terminates at the metallic carrier 520.

FIG. 5B illustrates a magnified view 540 of part of the metallic carrier 520 forming the matching circuit. The magnified view 540 illustrates a portion of the dielectric substrate 510 and a portion of the metallic carrier 520. The metallic carrier includes a port comprising a first portion 521 with a diameter 523 and a second portion 525 with a diameter 527. The diameter 523 is greater than the diameter 527. Although FIG. 5B illustrates two distinct portions of the metallic carrier 520, various embodiments are possible. For example, the first portion 521 and the second portion 525 can be tapered such that the first portion 521 between the second portion 525 and the substrate 510 has a greater diameter 523 than the diameter of the second portion 525.

The port, comprising the first portion 521 and the second portion 525, are configured to receive the transmission line 536. As illustrated in FIG. 5B, the transmission line 536 includes a first portion 536*a* and a second portion 536*b*. In the assembled antenna array 500, the second portion 536*b* is housed within the second portion 525 and the first portion 536*a* is housed within the first portion 521. Accordingly, the first portion 536*a* can have a greater diameter than the second portion 536*b*. The diameters of the first portion 536*a* and the first portion 521 can correspond while the diameters of the second portion 536*b* and the second portion 525 can correspond.

Although FIG. 5B illustrates two distinct portions of the transmission line 536, various embodiments are possible. For example, the first portion 536*a* and the second portion 536*b* can be tapered rather than provided as two distinct portions. In embodiments where the first portion 536*a* and the second portion 536*b* are tapered, the first portion 536*a* has a greater diameter that the diameter of the second portion 536*b*.

The metallic carrier 520 can also include a plurality of posts 529. The posts 529 are provided in between each of the transmission lines 536 to control leakage between the transmission lines 536. Controlling the leakage reduces cross-contamination of multiple linear sub-arrays 530*n*.

FIG. 5C illustrates a sub-array 530*n* according to various embodiments of the present disclosure. The sub-array 530*n* illustrated in FIG. 5C can be any of the sub-arrays 530*a*-530*n* illustrated in FIG. 5A. The sub-array 530*n* illustrated in FIG. 5C includes eight unit cells 532, a termination cell 534, and a transmission line 536. The transmission line 536 is provided to feed into and out of each unit cell 532 and feed into the termination cell 534. The eight unit cells 532, termination cell 534, and transmission line 536 are provided in a linear arrangement. The arrangement of the sub-array 530*n* will be described further in the description of FIGS. 7A-7E.

The sub-array 530*n* depicted in FIG. 5C is presented for illustration only and should not be construed as limiting. Various embodiments of the sub-array 530*n* are possible. For example, a sub-array 530*n* can include more than eight unit cells 532 or less than eight unit cells 532. The end of the transmission line 536 opposite of the termination cell 534 can terminate within a metallic carrier 520 as illustrated in FIG. 5B.

To increase the capacity of the antenna array 500, the unit cells can be dual-polarized rather than single-polarized. For example, various embodiments of the present disclosure provide unit cells that are dual-polarized and an antenna that includes sub-arrays that include the dual-polarized unit cells. More particularly, various embodiments of the present disclosure provide antennas with dual-polarized unit cells to provide relatively wide-angle beam steering and lower the possibility of scan blindness.

Figure 6A:
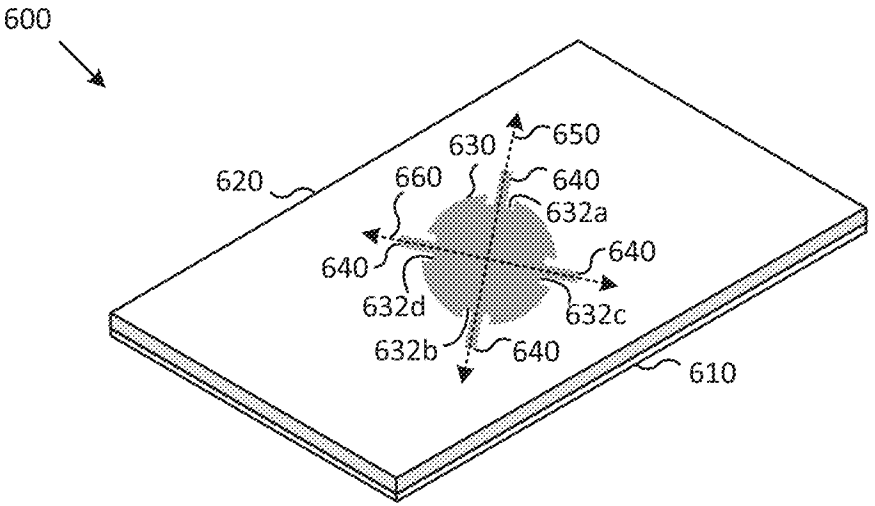
FIGS. 6A-6C illustrate a unit cell according to various embodiments of the present disclosure.
Figure 6B:
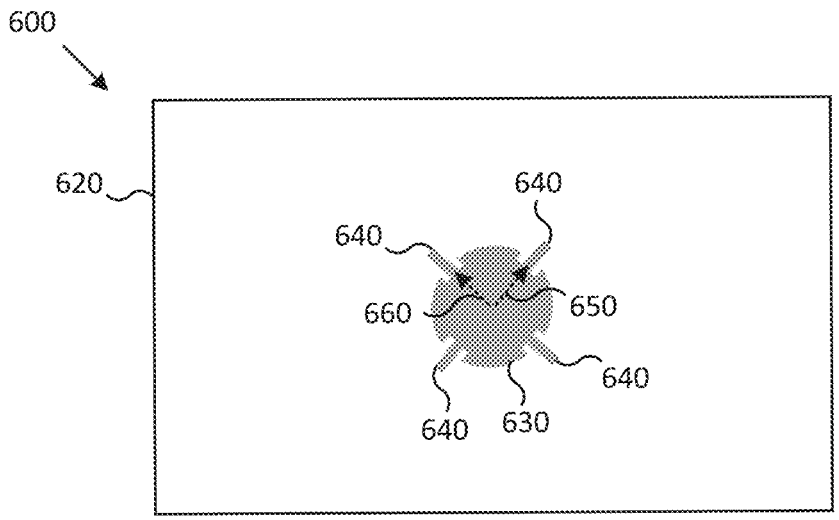
Figure 6C:
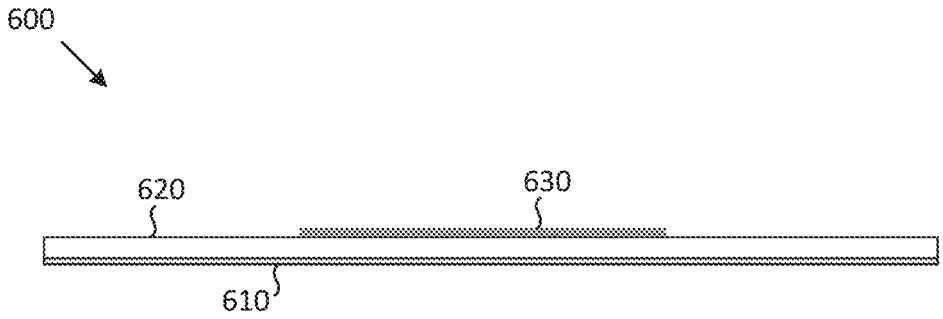

FIGS. 6A-6C illustrate a unit cell according to various embodiments of the present disclosure. The embodiment of the unit cell 600 illustrated in FIG. 6A is for illustration only and should not be construed as limiting. Various embodiments of the unit cell 600 are possible. FIG. 6A illustrates a top perspective view of a unit cell 600 according to various embodiments of the present disclosure. FIG. 6B illustrates a top view of a unit cell 600 according to various embodiments of the present disclosure. FIG. 6C illustrates a side view of a unit cell 600 according to various embodiments of the present disclosure.

The unit cell 600 can be implemented in various wireless communication devices, such as the UE 116 or the gNB 102. Some embodiments of the present disclosure provide a UE 116 that includes one or more arrays, where each array includes a plurality of unit cells 600. For example, as illustrated in FIGS. 7A-7D, the UE 116 can include a plurality of sub-arrays that each includes a plurality of unit cells such as the unit cell 600.

The unit cell 600 includes a single dielectric substrate layer 620. The dielectric substrate layer 620 can be provided on a ground plane 610 disposed under the unit cell 600. The ground plane 610 forms the bottom layer of the unit cell 600 and can be any suitable conducting surface used in an antenna that includes the unit cell 600. The ground plane 610 supports various propagation fundamental modes and improves the mechanical stability of the unit cell 600. Throughout the present disclosure, the terms "upper" and "lower" are not to be construed as limiting and are used only to describe the relative layers of the unit cell 600. For example, rotation of the unit cell 600 can result in the ground plane 610 being viewed as a top layer of the unit cell 600.

The dielectric substrate 620 can be any suitable insulating surface used in an antenna that includes the unit cell 600. In various embodiments, the dielectric substrate 620 can be described as a single layer that includes each and every element of the unit cell 600. In other embodiments, the unit cell can be described as including the ground plane 610 as an additional layer of the unit cell 600. Various other components of the unit cell 600 can be disposed on or within the dielectric substrate 620 as described herein.

The unit cell 600 includes a patch 630. As illustrated in FIG. 6C, the patch 630 can be a microstrip patch disposed on top of the dielectric substrate 620. In various other embodiments, the dielectric substrate 620 can include a machined section of material removed and the patch 630 can be disposed within the removed section of the dielectric substrate 620. In this embodiment, the patch 630 can be described as disposed within the dielectric substrate 620. The patch 630 can be provided in a circular shape, a rectangular shape, or a square shape.

The patch 630 includes at least four insets, or notches, 632 disposed on two diagonal axes. For example, the patch 630 can include two insets 632*a*, 632*b* disposed on a first diagonal axis 650 and two insets 632*c*, 632*d* disposed on a second diagonal axis 660. The first inset 632*a* is disposed one hundred-eighty degrees from the second inset 632*b*, corresponding to the first diagonal axis 650. The third inset 632*c* is disposed one hundred-eighty degrees from the fourth inset 632*d*, corresponding to the second diagonal axis 660. The four insets 632 reduce radiation and allow a beam to be more precisely steered.

The unit cell 600 includes four transmission lines 640 that can connect the unit cell 600 to another unit cell 600, a termination cell such as the termination cell 400, or the metallic carrier 520. The transmission lines 640 carry transmissions between the unit cell 600, a termination cell 400, and a metallic carrier 520. Each of the transmission lines 640 connect to the unit cell 600 at an inset 632. For example, a separate transmission line 640 connects to the unit cell 600 at each of the insets 632*a*, 632*b*, 632*c*, and 632*d*.

The unit cell 600 is dual-polarized by the transmission lines 640. The diagonal axis 650, 660 where each of the transmission lines 640 connect to one of the insets 632*a*, 632*b*, 632*c*, and 632*d* of the patch 630 provide a slanted polarization of approximately forty-five degrees. For example, the transmission line 640 connected to the inset 632*b* provides a plus forty-five degree slanted polarization while the transmission line 640 connected to the inset 632*c* provides a minus forty-five degree slanted polarization. Although described herein as plus or minus forty-five degree polarization, various embodiments are possible. For example, as described below in the descriptions of FIGS. 7A-7D, a unit cell can be dual-polarized in a forty-five degree slanted dual-polarization, a vertical/horizontal dual-polarization, or any other suitable arrangement of dual-polarization. Accordingly, various embodiments of the present disclosure, such as those illustrated in FIGS. 7A-7D, provide a single layer THz array antenna for wide angle beam steering that is cost-effective, fulfills the power requirements of THz communication systems, and compensates for the relatively high losses associated with THz communication systems.

Figure 7A:
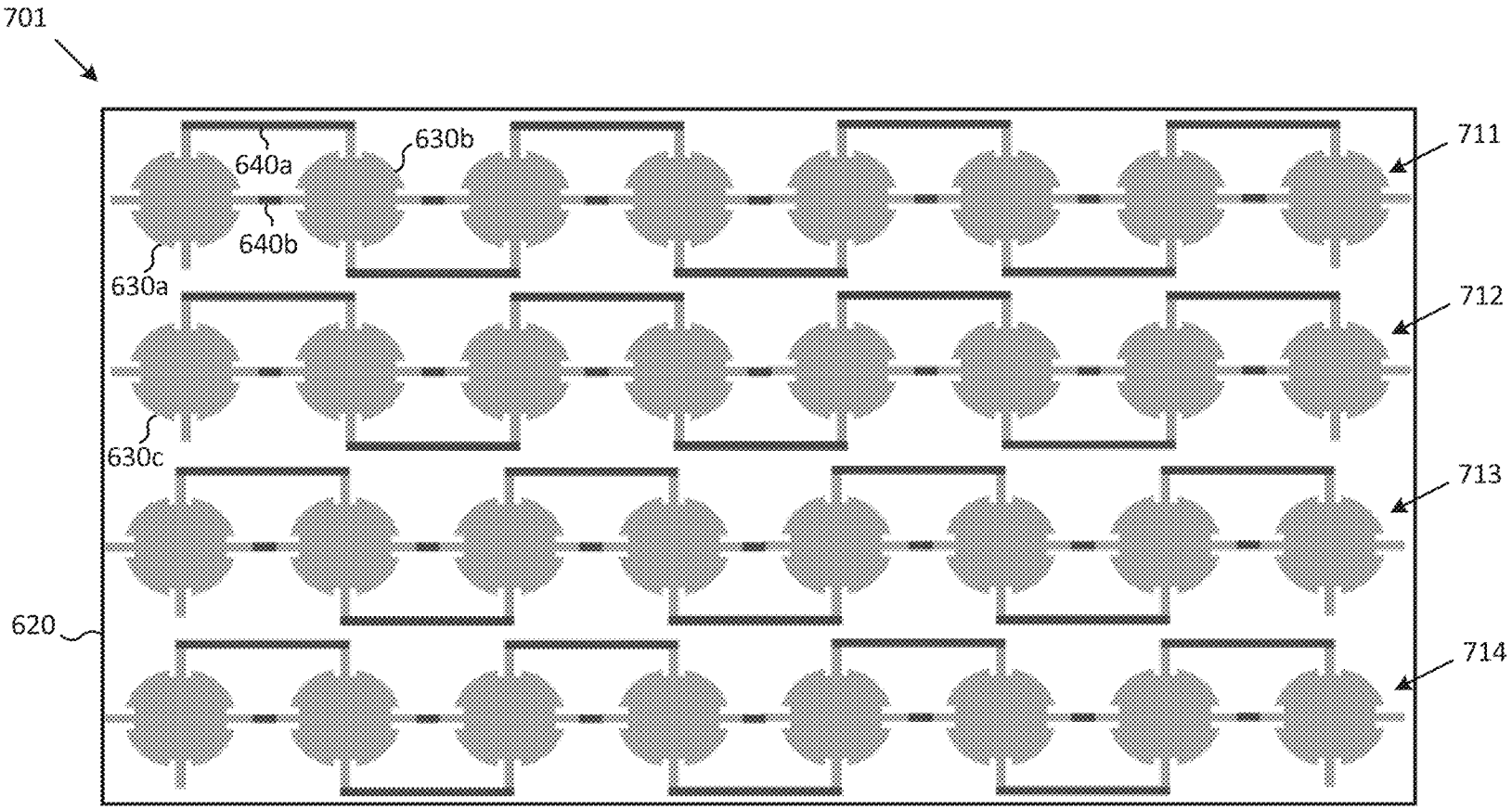
FIGS. 7A-7D illustrate a antenna arrays according to various embodiments of the present disclosure.

FIG. 7A illustrates an antenna array 701 according to various embodiments of the present disclosure. More particularly, FIG. 7A illustrates an antenna array 701 comprising regularly distributed sub-arrays 711, 712, 713, 714. Each of the sub-arrays 711, 712, 713, 714 include patches 630 and transmission lines 640. The patches 630 and transmission lines 640 can be included in the unit cell 600 described in FIGS. 6A-6C. The patches 630 and transmission lines 640 of the antenna array 701 are provided in a horizontal/vertical dual-polarization arrangement. For example, vertical polarization of the second patch 630*b* is provided by the first transmission line 640*a* while horizontal polarization of the second patch 630*b* is provided by the second transmission line 640*b*. Each of the first transmission line 640*a* and the second transmission line 640*b* carry a transmission from the first patch 630*a* to the second patch 630*b*. Based on the horizontal/vertical dual-polarization of the patches 630 in the sub-arrays 711, 712, 713, 714, the antenna array 701 provides horizontal/vertical polarized radiation. In some embodiments, each sub-array 711, 712, 713, 714 provides differential feeding to each unit cell in the sub-arrays 711, 712, 713, 714.

The patches 630 illustrated in FIG. 7A are provided in a regularly distributed array. Regular distribution refers to the rows and columns in which the patches 630 of the sub-arrays 711-714 are provided. For example, the patches 630 of each sub-array 711-714 are provided in a linear row. The first patch 630*a* of each sub-array 711-714 is provided in a column, the second patch 630*b* of each sub-array 711-714 is provided in another column, and so on. In this manner, the unit cells of the first sub-array 711 are in a forward in-phase feed while the unit cells of the second sub-array 712 are in a backwards, out-of-phase feed.

In some embodiments, the regular distribution of the sub-arrays 711, 712, 713, 714 can result in high mutual coupling. The amount of mutual coupling is dependent on the angles between each unit cell that includes the patches 630.

Figure 7B:
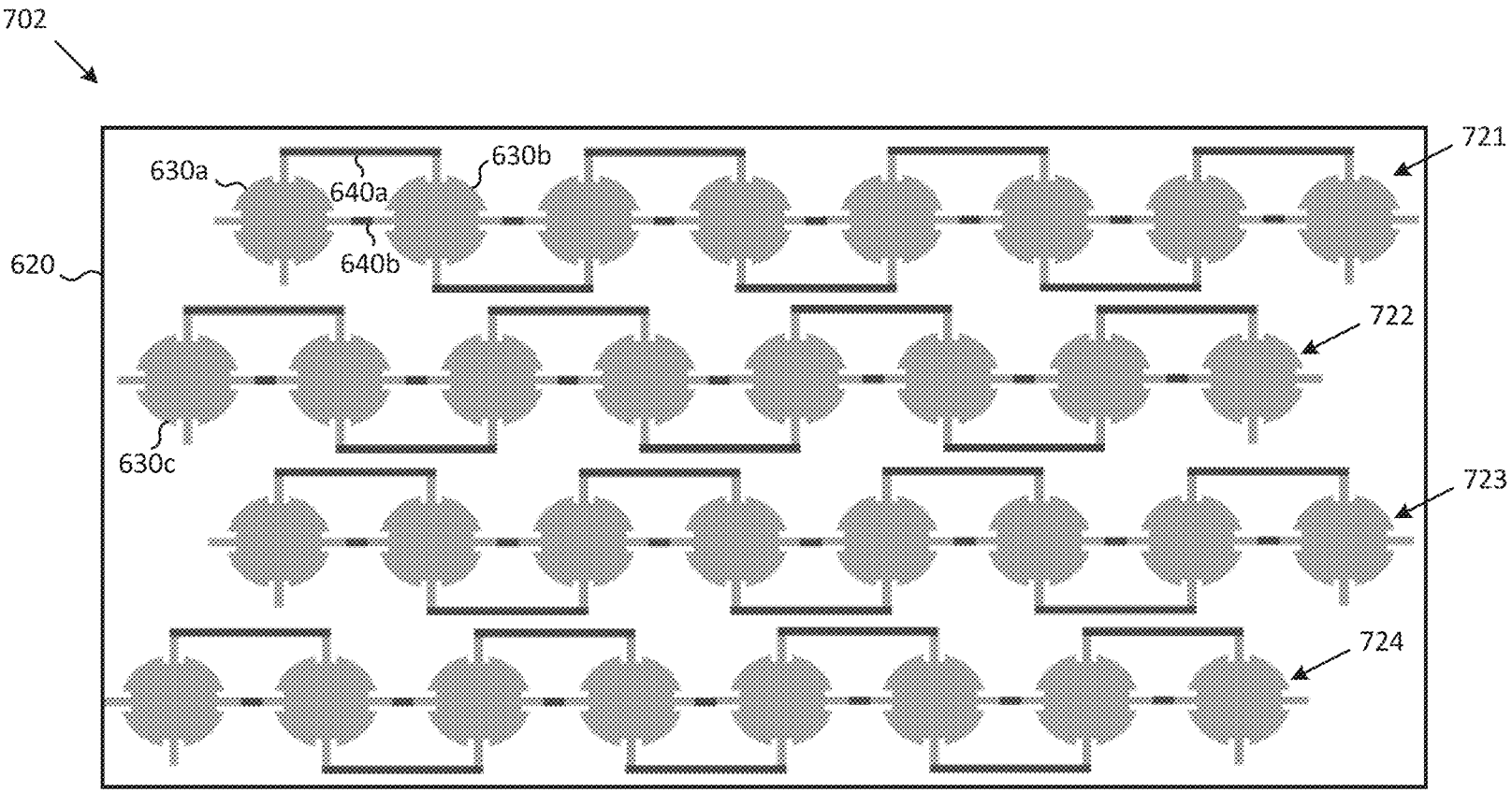

FIG. 7B illustrates an antenna array 702 according to various embodiments of the present disclosure. More particularly, FIG. 7B illustrates an antenna array 702 comprising staggered sub-arrays 721, 722, 723, 724. Each of the sub-arrays 721, 722, 723, 724 include patches 630 and transmission lines 640. The patches 630 and transmission lines 640 can be included in the unit cell 600 described in FIGS. 6A-6C. The patches 630 and transmission lines 640 of the antenna array 702 are provided in a horizontal/vertical dual-polarization arrangement. For example, vertical polarization of the second patch 630*b* is provided by the first transmission line 640*a* while horizontal polarization of the second patch 630*b* is provided by the second transmission line 640*b*. Each of the first transmission line 640*a* and the second transmission line 640*b* carry a transmission from the first patch 630*a* to the second patch 630*b*. Based on the horizontal/vertical dual-polarization of the patches 630 in the sub-arrays 721, 722, 723, 724, the antenna array 702 provides horizontal/vertical polarized radiation. In some embodiments, each sub-array 721, 722, 723, 724 provides differential feeding to each unit cell in the sub-arrays 721, 722, 723, 724.

The patches 630 illustrated in FIG. 7B are provided in a staggered distribution array. Staggered distribution refers to the staggered, forty-five degree offset of distribution of the patches 630 of the first sub-array 721 relative to the patches 630 of the second sub-array 722, the patches 630 of the second sub-array 722 relative to the patches 630 of the third sub-array 723, and the patches 630 of the third sub-array 723 relative to the patches 630 of the fourth sub-array 724. For example, the patch 630*a*, which is provided in sub-array 721, is offset forty-five degrees from the patch 630*c*, which is provided in sub-array 722. In this manner, the unit cells of the first sub-array 721 are in a forward in-phase feed while the unit cells of the second sub-array 722 are in a backwards, out-of-phase feed.

Embodiments of the present disclosure, as illustrated in FIG. 7B, change the angle between the unit cells including the patches 630 to reduce mutual coupling between individual elements. For example, the staggered distribution of the sub-arrays 721, 722, 723, 724 can reduce mutual coupling between the individual elements. Accordingly, embodiments of the present disclosure provide relatively wide-angle beam steering and lower the possibility of scan blindness by using a staggered arrangement of dual-polarized unit cells in multiple sub-arrays.

Figure 7C:
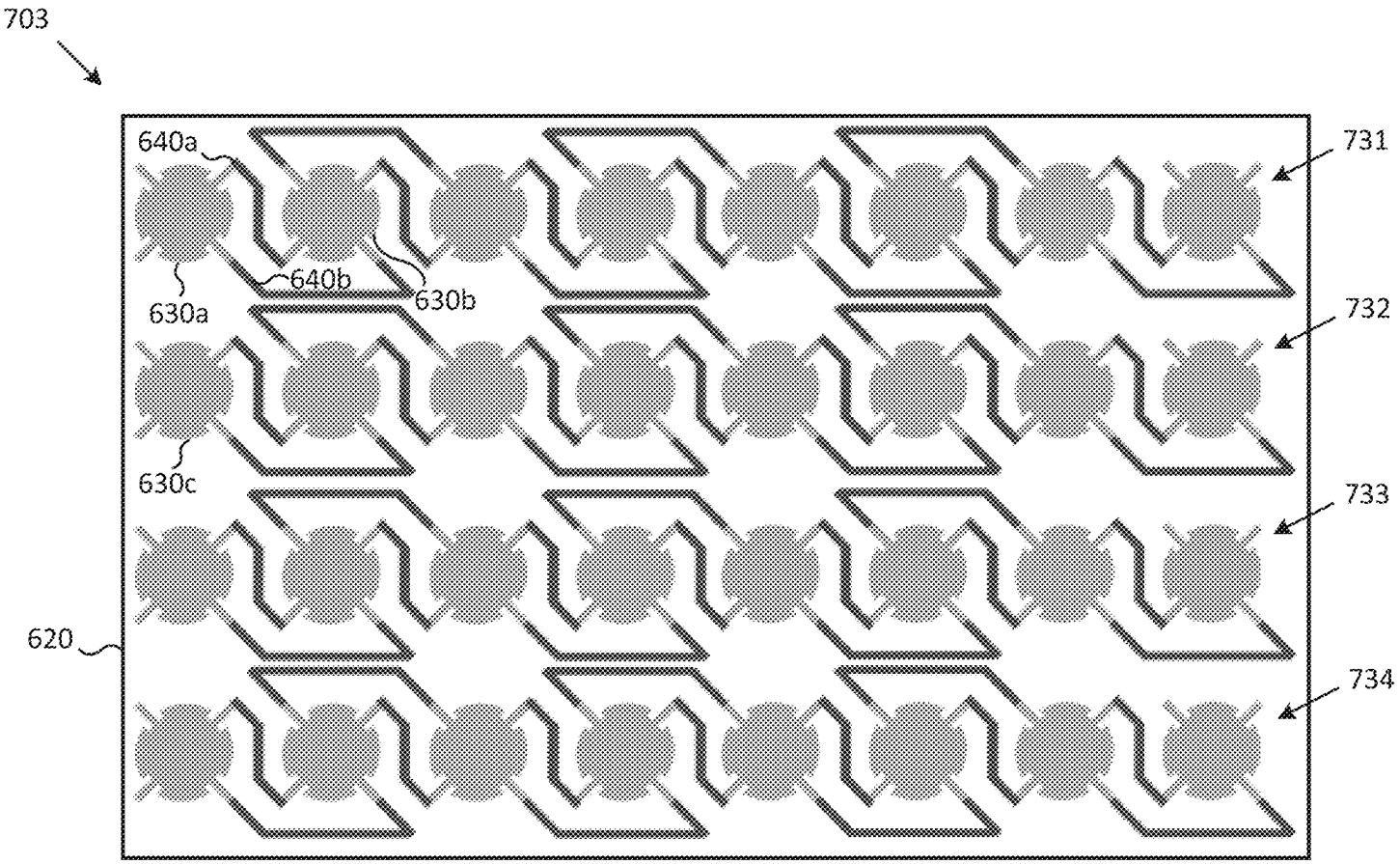

FIG. 7C illustrates an antenna array 703 according to various embodiments of the present disclosure. More particularly, FIG. 7C illustrates an antenna array 703 comprising regularly distributed sub-arrays 731, 732, 733, 734. Each of the sub-arrays 731, 732, 733, 734 include patches 630 and transmission lines 640. The patches 630 and transmission lines 640 can be included in the unit cell 600 described in FIGS. 6A-6C. The patches 630 and transmission lines 640 of the antenna array 703 are provided in a slanted, plus/minus forty-five degree dual-polarization arrangement. For example, plus forty-five degree polarization of the second patch 630*b* is provided by the first transmission line 640*a* while minus forty-five degree polarization of the second patch 630*b* is provided by the second transmission line 640*b*. Each of the first transmission line 640*a* and the second transmission line 640*b* carry a transmission from the first patch 630*a* to the second patch 630*b*. Based on the slanted, plus/minus forty-five degree dual-polarization of the patches 630 in the sub-arrays 731, 732, 733, 734, the antenna array 703 provides slanted, plus/minus forty-five degree polarized radiation.

The patches 630 illustrated in FIG. 7C are provided in a regularly distributed array. Regular distribution refers to the ninety-degree distribution of the patches 630 of the first sub-array 731 relative to the patches 630 of the second sub-array 732, the patches 630 of the second sub-array 732 relative to the patches 630 of the third sub-array 733, and the patches 630 of the third sub-array 733 relative to the patches 630 of the fourth sub-array 734. For example, the patch 630*a*, which is provided in sub-array 731, is provided at a ninety-degree angle from the patch 630*c*, which is provided in sub-array 732.

In some embodiments, the regular distribution of the sub-arrays 731, 732, 733, 734 can result in high mutual coupling. The mutual coupling depends on the angles between each unit cell that includes the patches 630.

Figure 7D:
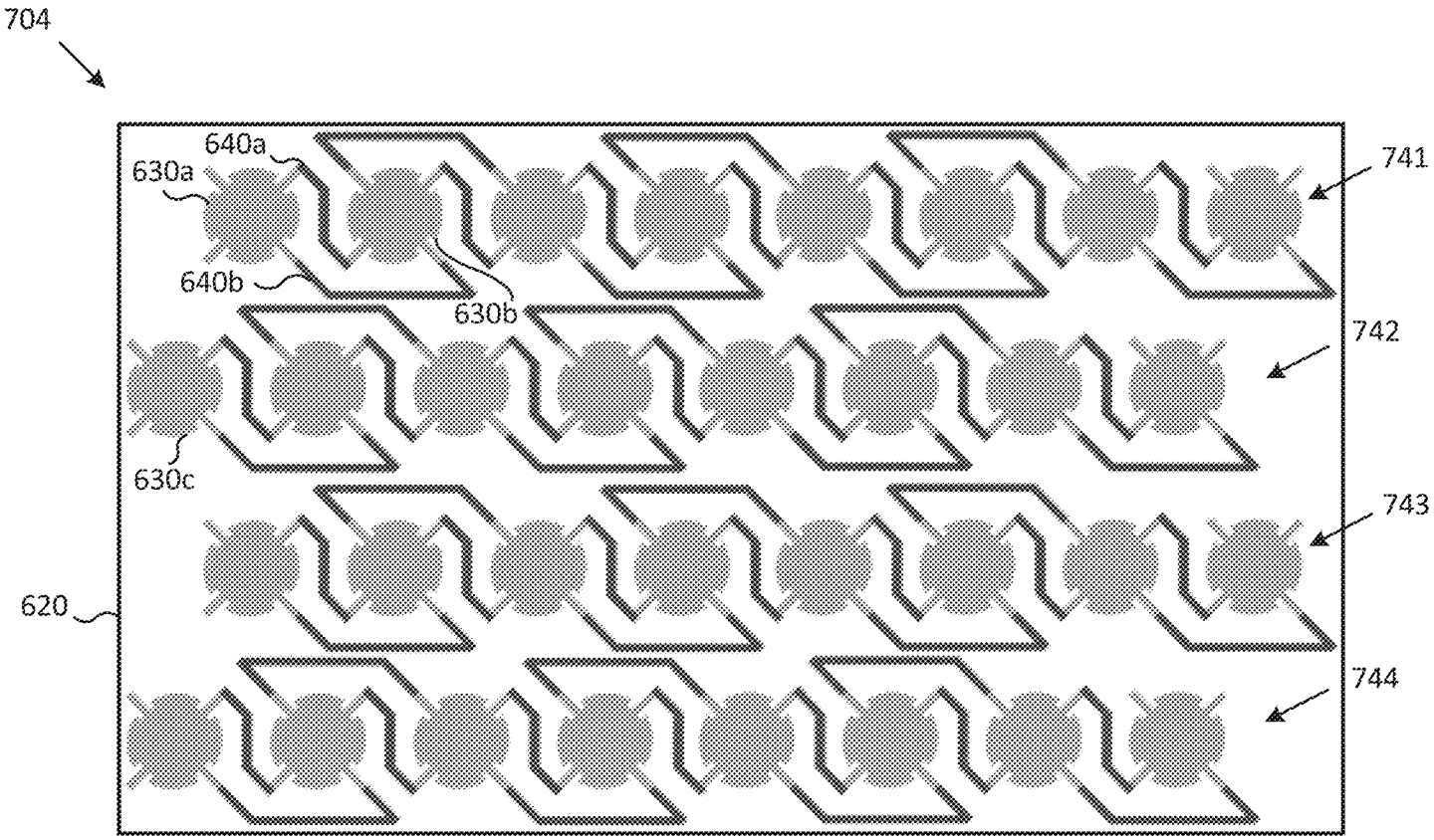

FIG. 7D illustrates an antenna array 704 according to various embodiments of the present disclosure. More particularly, FIG. 7D illustrates an antenna array 704 comprising staggered sub-arrays 741, 742, 743, 744. Each of the sub-arrays 741, 742, 743, 744 include patches 630 and transmission lines 640. The patches 630 and transmission lines 640 can be included in the unit cell 600 described in FIGS. 6A-6C. The patches 630 and transmission lines 640 of the antenna array 704 are provided in a slanted, plus/minus forty-five degree dual-polarization arrangement. For example, plus forty-five degree polarization of the second patch 630*b* is provided by the first transmission line 640*a* while minus forty-five degree polarization of the second patch 630*b* is provided by the second transmission line 640*b*. Each of the first transmission line 640*a* and the second transmission line 640*b* carry a transmission from the first patch 630*a* to the second patch 630*b*. Based on the slanted, plus/minus forty-five degree dual-polarization of the patches 630 in the sub-arrays 741, 742, 743, 744, the antenna array 704 provides horizontal/vertical polarized radiation.

The patches 630 illustrated in FIG. 7D are provided in a staggered distribution array. Staggered distribution refers to the staggered, forty-five degree offset of distribution of the patches 630 of the first sub-array 741 relative to the patches 630 of the second sub-array 742, the patches 630 of the second sub-array 742 relative to the patches 630 of the third sub-array 743, and the patches 630 of the third sub-array 743 relative to the patches 630 of the fourth sub-array 744. For example, the patch 630*a*, which is provided in sub-array 741, is offset forty-five degrees from the patch 630*c*, which is provided in sub-array 742.

Embodiments of the present disclosure, as illustrated in FIG. 7D, change the angle between the unit cells including the patches 630 to reduce mutual coupling between individual elements. For example, the staggered distribution of the sub-arrays 741, 742, 743, 744 can reduce mutual coupling between the individual elements. Accordingly, embodiments of the present disclosure provide relatively wide-angle beam steering and lower the possibility of scan blindness by using a staggered arrangement of dual-polarized unit cells in multiple sub-arrays.

The antenna arrays 701, 702, 703, 704 can be implemented in various wireless communication devices, such as the UE 116 or the gNB 102. Some embodiments of the present disclosure provide a UE 116 that includes one or more arrays, such as the antenna arrays 701, 702, 703, 704.

As described herein, various embodiments of the present disclosure include an antenna array. The antenna array includes a plurality of unit cells and a termination unit cell. The plurality of unit cells are connected in series via respective transmission lines. Each of the unit cells includes a microstrip patch having two insets on a diagonal axis of the microstrip patch. The microstrip patch is connected to two of the transmission lines at the two insets, respectively. The termination unit cell is connected in series to one of the plurality of unit cells via one of the transmission lines. The termination unit cell includes a microstrip patch having an inset on a diagonal axis of the microstrip patch. The microstrip patch is connected to the one transmission line at the inset.

In some embodiments, the microstrip patches of the unit cells have a circular shape. In addition, a first of the two insets of the unit cell is disposed on an opposite side of the unit cell from a second of the two insets of the unit cell. In some embodiments, the transmission lines control a phase input and a phase output and are series-fed diagonally into and out of, respectively, each of the two insets of the unit cells.

In some embodiments, the antenna array includes a first sub-array comprising the plurality of unit cells and the termination unit cell, where the unit cells in the first sub-array in a forward in-phase feed. The antenna array further includes a second sub-array including a second plurality of unit cells in a backwards, out-of-phase feed. The first sub-array and the second sub-array provide differential feeding to each unit cell of the plurality of unit cells and the second plurality of unit cells, and the second plurality of unit cells are provided in a staggered arrangement at an offset relative to the plurality of unit cells.

In some embodiments, the antenna array includes a first sub-array comprising the plurality of unit cells and the termination unit cell, where the unit cells in the first sub-array in a forward in-phase feed. The antenna array further includes a second sub-array including a second plurality of unit cells in a backwards, out-of-phase feed. The plurality of unit cells and the second plurality of unit cells are provided in rows and columns.

In some embodiments, the transmission lines, the microstrip patch of the unit cells, and the microstrip patch of the termination unit cell are provided on a single dielectric substrate. In some embodiments, the microstrip patch of each of the unit cells further has a third inset and a fourth inset, and the microstrip patch is connected to third and fourth transmission lines at the third inset and the fourth inset, respectively.

In some embodiments, the antenna array can further include a sub-array comprising the plurality of unit cells and the termination unit cell, and the insets are disposed on the microstrip patches in a vertical direction and a horizontal direction.

In some embodiments, the antenna array can further include a sub-array comprising the plurality of unit cells and the termination unit cell, and the insets are disposed on the microstrip patches in a forty-five degree slanted offset.

In some embodiments, the antenna array can further include a matching circuit comprising a port configured to receive the transmission line from one of the unit cells.

Various embodiments of the present disclosure include a wireless communication device. The wireless communication device includes a transceiver and an antenna array operably connected thereto. The antenna array includes a sub-array that includes a plurality of unit cells and a termination unit cell. The plurality of unit cells are connected in series via respective transmission lines. Each of the unit cells includes a microstrip patch having two insets on a diagonal axis of the microstrip patch. The microstrip patch is connected to two of the transmission lines at the two insets, respectively. The termination unit cell is connected in series to one of the plurality of unit cells via one of the transmission lines. The termination unit cell includes a microstrip patch having an inset on a diagonal axis of the microstrip patch. The microstrip patch is connected to the one transmission line at the inset.

Although the present disclosure has been described with an exemplary embodiment, various changes and modifications may be suggested to one skilled in the art. It is intended that the present disclosure encompass such changes and modifications as fall within the scope of the appended claims. None of the description in this application should be read as implying that any particular element, step, or function is an essential element that must be included in the claims scope. The scope of patented subject matter is defined by the claims.

What is claimed is:

1. An antenna array comprising:

a plurality of unit cells connected in series via respective transmission lines, the unit cells positioned in a first direction, each of the unit cells including a unit cell microstrip patch having two insets on a diagonal axis of the unit cell microstrip patch, the diagonal axis being diagonal to the first direction, the unit cell microstrip patch connected to two of the transmission lines at the two insets, respectively, the transmission lines having at least a curved portion; and a termination unit cell connected in series to one of the plurality of unit cells via one of the transmission lines, the termination unit cell including a termination unit cell microstrip patch having an inset on a diagonal axis of the termination unit cell microstrip patch, the termination unit cell microstrip patch connected to the one transmission line at the inset.

2. The antenna array of claim 1, wherein:

the unit cell microstrip patches have a circular shape, and a first of the two insets of the unit cell is disposed on an opposite side of the unit cell from a second of the two insets of the unit cell.

3. The antenna array of claim 1, wherein the transmission lines control a phase input and a phase output and are series-fed diagonally into and out of, respectively, each of the two insets of the unit cells.

4. The antenna array of claim 1, further comprising:

a first sub-array comprising the plurality of unit cells and the termination unit cell, the unit cells in the first sub-array in a forward in-phase feed; and a second sub-array including a second plurality of unit cells in a backwards, out-of-phase feed, wherein:

the first sub-array and the second sub-array provide differential feeding to each unit cell of the plurality of unit cells and the second plurality of unit cells, and the second plurality of unit cells are provided in a staggered arrangement at an offset relative to the plurality of unit cells.

5. The antenna array of claim 1, further comprising:

a first sub-array comprising the plurality of unit cells and the termination unit cell, the unit cells in the first sub-array in a forward in-phase feed; and a second sub-array including a second plurality of unit cells in a backwards, out-of-phase feed, wherein the plurality of unit cells and the second plurality of unit cells are provided in rows and columns.

6. The antenna array of claim 1, wherein the transmission lines, the unit cell microstrip patch, and the termination unit cell microstrip patch are provided on a single dielectric substrate.

7. The antenna array of claim 1, wherein each of the unit cell microstrip patches further has a third inset and a fourth inset, each the unit cell microstrip patches connected to third and fourth transmission lines, respectively, at the third inset and the fourth inset, respectively.

8. The antenna array of claim 7, further comprising a sub-array comprising the plurality of unit cells and the termination unit cell.

9. The antenna array of claim 7, further comprising a sub-array comprising the plurality of unit cells and the termination unit cell, wherein the insets are disposed on the unit cell microstrip patches and the termination unit cell microstrip patches in a forty-five degree slanted offset.

10. The antenna array of claim 1, further comprising a matching circuit comprising a port configured to receive the transmission line from one of the unit cells.

11. A wireless communication device comprising:

a transceiver; and an antenna array operably connected to the transceiver, the antenna array including:

a plurality of unit cells connected in series via respective transmission lines, the unit cells positioned in a first direction, each of the unit cells including a unit cell microstrip patch having two insets on a diagonal axis of the unit cell microstrip patch, the diagonal axis being diagonal to the first direction, the unit cell microstrip patch connected to two of the transmission lines at the two insets, respectively, the transmission lines having at least a curved portion; and a termination unit cell connected in series to one of the plurality of unit cells via one of the transmission lines, the termination unit cell including a termination unit cell microstrip patch having an inset on a diagonal axis of the termination unit cell microstrip patch, the termination unit cell microstrip patch connected to the one transmission line at the inset.

12. The wireless communication device of claim 11, wherein:

the unit cell microstrip patches have a circular shape, and a first of the two insets of the unit cell is disposed on an opposite side of the unit cell from a second of the two insets of the unit cell.

13. The wireless communication device of claim 11, wherein the transmission lines control a phase input and a phase output and are series-fed diagonally into and out of, respectively, each of the two insets of the unit cells.

14. The wireless communication device of claim 11, wherein the antenna array includes:

a first sub-array comprising the plurality of unit cells and the termination unit cell, the unit cells in the first sub-array in a forward in-phase feed; and a second sub-array including a second plurality of unit cells in a backwards, out-of-phase feed, wherein:

the first sub-array and the second sub-array provide differential feeding to each unit cell of the plurality of unit cells and the second plurality of unit cells, and the second plurality of unit cells are provided in a staggered arrangement at an offset relative to the plurality of unit cells.

15. The wireless communication device of claim 11, wherein the antenna array includes:

a first sub-array comprising the plurality of unit cells and the termination unit cell, the unit cells in the first sub-array in a forward in-phase feed; and a second sub-array including a second plurality of unit cells in a backwards, out-of-phase feed, wherein the plurality of unit cells and the second plurality of unit cells are provided in rows and columns.

16. The wireless communication device of claim 11, wherein the transmission lines, the unit cell microstrip patch, and the termination unit cell microstrip patch are provided on a single dielectric substrate.

17. The wireless communication device of claim 11, wherein each of the unit cell microstrip patches further has a third inset and a fourth inset, each of the unit cell microstrip patches connected to third and fourth transmission lines respectively, at the third inset and the fourth inset, respectively.

18. The wireless communication device of claim 17, wherein the insets are disposed on the unit cell microstrip patches and the termination unit cell microstrip patches in a forty-five degree slanted offset.

19. The wireless communication device of claim 11, wherein the antenna array further comprises a matching circuit comprising a port configured to receive the transmission line from one of the unit cells.

* * * * *